United States Patent [19]

Lin

[11] Patent Number: 4,965,705

[45] Date of Patent: Oct. 23, 1990

[54] ELECTRONIC BADGE HAVING DOUBLE-EFFECT PINS

[76] Inventor: Wen-Tsung Lin, P.O. Box 74-9, Taipei, Taiwan

[21] Appl. No.: 495,397

[22] Filed: Mar. 19, 1990

[51] Int. Cl.[5] ..... F21L 15/08

[52] U.S. Cl. ..... 362/103; 362/104; 362/191; 362/251; 362/394; 362/800; 362/806

[58] Field of Search ..... 40/1, 5; 362/103, 104, 362/251, 252, 184, 191, 394, 296, 802, 806, 811, 234, 800

[56] References Cited

U.S. PATENT DOCUMENTS

| | | | |
|---|---|---|---|
| 3,866,035 | 2/1975 | Richey, Jr. | 362/104 |
| 4,076,976 | 2/1978 | Fenton | 362/104 |
| 4,719,544 | 1/1988 | Smith | 362/104 |

*Primary Examiner*—Stephen F. Husar

[57] ABSTRACT

An electronic badge includes a front plate having a plurality of illuminators formed therein and a pair of pins protruding rearwardly from the front plate electrically connected with two power input pins of a flasher integrated circuit formed in the front plate for driving and flashing the illuminators, and a button having at least a battery fixed in the button provided with two clips respectively connected with two poles of the battery for coupling the two pins and the front plate and for powering the illuminators for their flashing, whereby upon a disengagement of the two clips of the power source from their corresponding two pins, the power lead to the illuminators will be disconnected to switch off the illuminators.

5 Claims, 2 Drawing Sheets

ELECTRONIC BADGE HAVING DOUBLE-EFFECT PINS

BACKGROUND OF THE INVENTION

Paul Acson et. al disclosed a display element in their U.S. Pat. No. 4,531,310 including a graphic and pictorial information display element, a synthesizer element for electronic sound reproduction and a backing plate which couples to the display element and thereby defines a chamber for housing the synthesizer. However, such a display element has the following drawbacks:

1. The switching member 14, especially as shown in their FIGS. 1 and 2, is protruded outwardly beyond the face member 12 so that the switch should be matched with a specific spot of a decorative figure printed on the face member 12 such as a "nose" area of a mickey mouse as shown in FIG. 1 and is therefore quite limited for allocating such a switch.

2. The protruded switch is not suitable for a flat badge or medal requiring a smooth flat surface.

3. The switch 14 may be easily falsely operated since it is formed on an outside surface on the display element.

The present inventor has found the drawbacks of such a conventional display element and invented the present electronic badge.

SUMMARY OF THE INVENTION

The object of the present invention is to provide an electronic badge including a front plate having an illuminating means formed thereon having two electrically conductive pins protruding inwardly from the illuminating means, and a rear button having at least a battery fixed in the button coupled to the front plate by operatively engaging two clips respectively connected to two poles of the battery for powering the illuminating means for lighting a plurality of light-emitting diodes or bulbs of the illuminating means. The button may also be inverted or rotated to disconnect the illuminating means with the power source.

DETAILED DESCRIPTION

Figure 1:
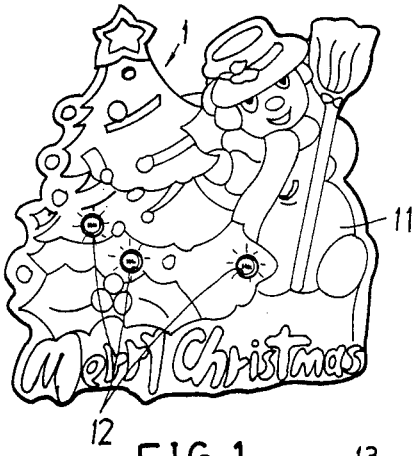
FIG. 1 is a front illustration of the present invention.

As shown in FIGS. 1–7, the present invention comprises: a front plate 1, a rear button 2, an illuminating means 3 and a power source 4.

The front plate 1 includes a front surface 11 printed with decorative figures, a plurality of illuminating holes 12 formed through the plate 1 and a rear surface 13 opposite to the front surface 11 for fixing the illuminating means 3 thereon.

The rear button 2 includes a base 21 for mounting the power source 4 thereon and a housing 22 covering the base 21 and the power source 4. The shape may be made as a heart or any other fancy shape or may be formed with a mark which can be easily distinguished from its elevational state or inverted state. Two pin holes 211, 212 are respectively formed in the base 21.

Figure 2:
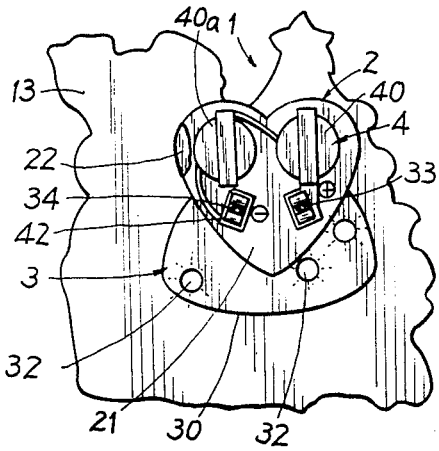
FIG. 2 is a rear view of the present invention.
Figure 3:
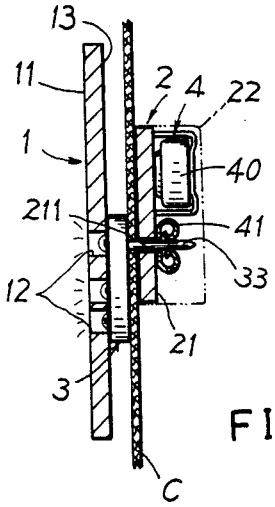
FIG. 3 is a side view of the present invention.
Figure 4:
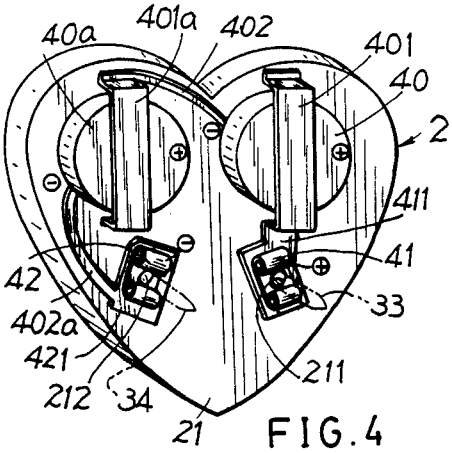
FIG. 4 is an illustration showing the power source formed on the button.
Figure 5:
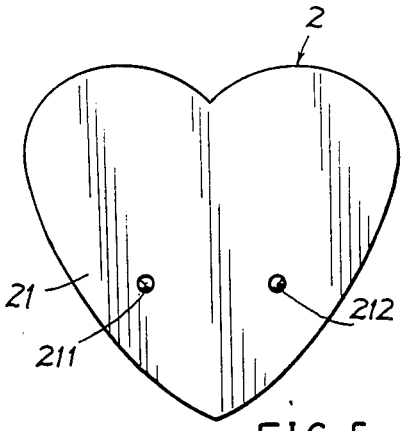
FIG. 5 is a back view of the button as shown in FIG. 4.

As shown in FIGS. 2, 3 and 4, the power source 4 includes two batteries 40, **40*a* fixed on the base 21 of the button 2. Naturally, a single battery or plural batteries may be modified in this invention. A first battery 40 is fixed on a first battery 40*a* is fixed on the other (second) fastener 401*a* secured on the base 21, whereas a second battery 40*a* is fixed on the other (second) fastener 401*a* aside the first battery 40. The first fastener 401 is electrically conducted with a positive pole of the first battery 40 and is electrically connected to a positive clip 41 through a clip base 411 fixed on the base 21. The second battery fastener 401*a* is electrically conducted with the positive pole of the second battery 40*a* and also connected to a negative pole of the first battery 40 through a contactor strip 402 printed or formed on the base 21. A negative pole of the second battery 40*a* is electrically connected to a negative clip 42 fixed on the base 21 through a contactor strip 402*a* printed or formed on the base 21. If it is a single battery 40 used in this invention, the positive pole of the battery is connected to the positive clip 41, while the negative pole of the battery is connected to the negative clip 42. The housing 22 and base 21** is made of electric insulating materials.

The illuminating means 3 includes a printed circuit board 30 fixed on the rear surface 13 of the front plate 1 having a substrate plate made of electric insulating materials, a flasher integrated circuit (IC) 31 formed on the board 30, a plurality of illuminators 32 connected to and driven by the flasher IC 31, a first pin 33 connected to positive input pin VDD of the IC 31 operatively engaging the positive clip 41 of the power source 4, a second pin 34 connected to a negative input pin VSS of the IC 31 operatively engaging the negative clip 42 of the power source 4, and a forward-biased diode 35 connected between the first pin 33 and the positive input pin VDD of the IC 31 with the anode of the diode 35 connected to the first pin 33 and the cathode of diode 35 connected to the positive input pin VDD of IC 31. The flasher IC 31 may intermittently illuminate or sequentially flash the plural illuminators 32 which may be selected from light-emitting diodes (LED) or bulbs.

Figure 7:
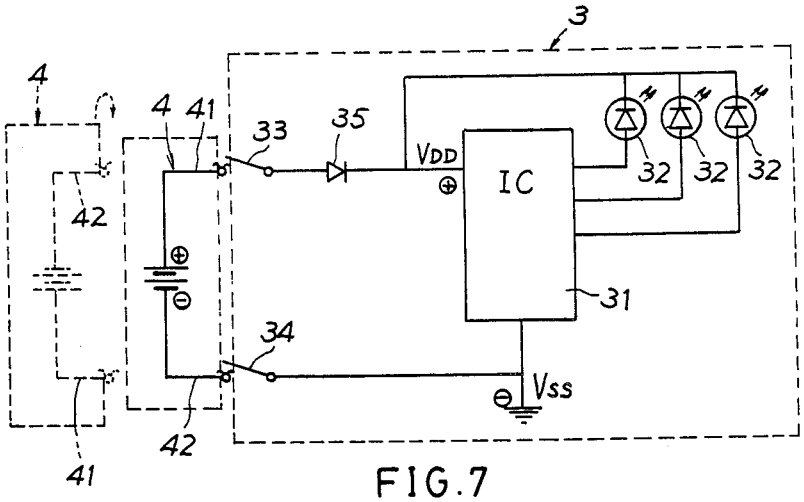
FIG. 7 is a circuit diagram of the present invention.

When using the present invention for an illuminating ornamental purpose, the two pins 33, 34 of the illuminating means 3 fixed on the front plate 1 are inserted through a wearer's clothes C as shown in FIG. 3 to respectively engage the two clips 41, 42 in the button 2 as shown in FIG. 2, 4 for firmly clamping the badge on the wearer's clothes. As shown in FIG. 7, the first pin 33 is engaged with the positive clip 41 of the power source 4 and the second pin 34 is connected with the negative clip 42 of the power source 4. Since the diode 35 is forward biased towards the VDD of IC 31, a forward current will enter IC 31 for powering and lighting up (flashing) the illuminators 32 for ornamental purpose through the holes 12 formed in the badge of the invention. The button 2 shaped as heart shape is in its elevational state to indicate the correct coupling of the two pins 33, 34 respectively with the two clips 41, 42 for lighting the illuminators 32.

Figure 6:
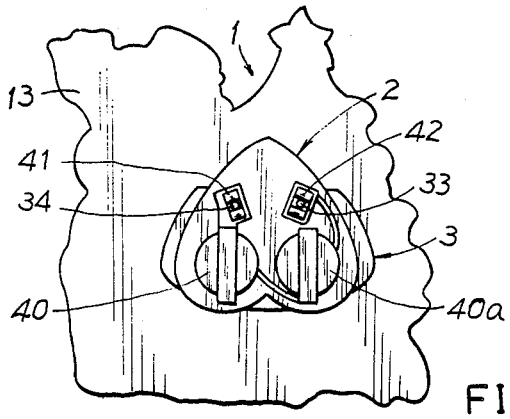
FIG. 6 is a rear view of the present invention when switched off.

If the badge is not to be lit, the heart-shaped button 2 may be removed from the two pins 33, 34 and inverted (turned at 180 degrees) to engage the two clips 42, 41 respectively with the two pins 33, 34 as an inverse heart-shaped button 2 as shown in FIG. 6 and dotted line shown in FIG. 7, in which the diode 35 will not be conducted and will interrupt the current passing through the IC 31, thereby switching off the power of the illuminators 32.

Figure 8:
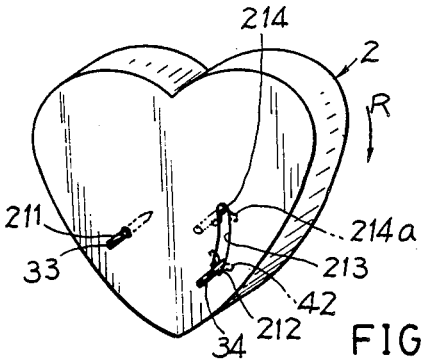
FIG. 8 shows another preferred embodiment of the present invention.

Another preferred embodiment of the present invention is modified as FIG. 8, in which a second pin hole 212 for engaging the second pin 34 aside the first pin hole 211 is enlarged to form an arcuate slot 213 formed in the base 21 of the button 2. The arcuate slot 213 has a curvature with its center coinciding with a center of the first hole 211 for engaging the first pin 33. The slot 213 is limited at an upper hole 214. Around the lower second pin hole 212, the negative clip 42 is disposed around the second hole 212 in the button 2 for engaging the second pin 34 for powering the illuminators 32. A spring clip **214*a* is disposed around the upper hole 214 so that when rotating the button 2 around the center of first pin 33 and first hole 211 in direction R to move the second pin 34 to disengage from the hole 212 and clip 42, to be finally engaged with the upper hole 214 and clip 214*a*, thereby switching off the power of the illuminators 32. By this way, it is not necessary to withdraw the button 2 from the pins 33, 34 of the front plate 1 as aforementioned. It is simply operated by biasing the button 2 to disconnect the clip 42 from the pin 34. In the circuit diagram of the latter modification, the diode 35** may then be eliminated.

The present invention has the following advantages in comparison with the prior art of Acson's U.S. Patent:

1. No additional switching member is required in this invention for saving production cost.

2. The front surface of the badge can be made as flat surface without damaging or influencing the figure or shape of the badge appearance.

3. The two pins 33, 34 serve for double effects, both for coupling the front plate 1 with the button 2 and also for electric contactors for connecting the power source 4 with the illuminators 32.

What is claimed:

1. An electronic badge comprising:

a front plate having decorative figures printed or formed on its front surface, a plurality of illuminating holes formed through the plate;

a button having a base formed with two pin holes in said base and a housing for covering the base, shaped or marked to be distinguishable from an elevational or inverted state of the button;

a power source formed in said button having a positive clip connected to a positive pole of a battery and a negative clip connected to a negative pole of the battery; and an illuminating means including a flasher integrated circuit formed on a printed circuit board fixed on a rear surface of said front plate, a plurality of illuminators connected to and driven by said flasher integrated circuit, a first pin operatively engaging said positive clip of said power source and connected to a positive input pin of said flasher integrated circuit through a forward-biased diode, and a second pin operatively engaging said negative clip of said power source and connected to a negative input pin of said flasher integrated circuit, said first pin and said second pin of said illuminating means served for passing through a wearer's clothes and two said pin holes in said button for engaging two said clips of said power source fixed in said button for coupling said front plate with said button, said forward-biased diode of said illuminating means having an anode connected to said first pin and having a cathode connected to said positive input pin of said flasher integrated circuit, whereby upon an engagement of said first pin with said positive clip of said power source and an engagement of said second pin with said negative clip of said power source for keeping the button at its elevational state, a forward current is led through said diode to power said flasher integrated circuit for flashing said illuminators, and whereby upon a withdrawal of said button from said two pins and an inversion of said button to engage said second pin with said positive clip of said power source and engage said first pin with said negative clip, said flasher integrated circuit is not powered to switch off said illuminators.

2. An electronic badge according to claim 1, wherein said illuminators are selected from light-emitting diodes and bulbs.

3. An electronic badge according to claim 1, wherein said button is shaped as a heart shape.

4. An electronic badge comprising:

a front plate having an illuminating means formed thereon provided with two pins protruding rearwardly;

a button having a power source consisting of a plurality of batteries connected in series mounted in said button, said button having two pin holes formed thereon to be coupled with two said pins formed on said illuminating means and said front plate;

said button formed with a first pin hole having a positive clip of said power source disposed around said first pin hole for engaging a first pin of said illuminating means, and having an arcuate slot formed in said button starting from a second pin hole and stopping at a limiting hole apart from the second pin hole, a negative clip of said power source disposed around said second pin hole for engaging a second pin of said illuminating means, said arcuate slot having a curvature with its center coinciding with a center of said first pin hole, whereby upon an engagement of two said pins with said positive and negative clips of said power source, said illuminating means will be powered by said power source, and whereby upon rotation or biasing of said button around said first pin hole, said second pin will be moved to disengage from said negative clip to disconnect the power source of the illuminating means.

5. An electronic badge according to claim 4, wherein said limiting hole of said arcuate slot is disposed around by a spring clip for retaining the second pin when disengaged from the negative clip of the power source positioned at the second pin hole.

* * * * *